US010584930B2

(12) United States Patent
Laney et al.

(10) Patent No.: US 10,584,930 B2
(45) **Date of Patent: *Mar. 10, 2020**

(54) ROTARY MAGAZINE AND BOLT CATCH

(71) Applicant: Smith & Wesson Corp., Springfield, MA (US)

(72) Inventors: Mark C. Laney, Lee, NH (US); Matteo V. Viviano, Harrison Township, MI (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/420,294

(22) Filed: May 23, 2019

(65) Prior Publication Data

US 2019/0301822 A1 Oct. 3, 2019

Related U.S. Application Data

(62) Division of application No. 15/787,797, filed on Oct. 19, 2017, now Pat. No. 10,345,064.

(51) Int. Cl.

| | |
|---|---|
| ***F41A 9/74*** | (2006.01) |
| ***F41A 17/36*** | (2006.01) |
| ***F41A 9/73*** | (2006.01) |

(52) U.S. Cl.

CPC *F41A 9/74* (2013.01); *F41A 9/73* (2013.01); *F41A 17/36* (2013.01)

(58) Field of Classification Search

CPC ..... F41A 17/36; F41A 17/40; F41A 17/42; F41A 17/34; F41A 9/61; F41A 9/73; F41A 9/74; F41A 9/75

USPC ..... 89/33.02, 137, 142, 148; 42/49.01, 42/49.02, 70.02

See application file for complete search history.

(56) References Cited

U.S. PATENT DOCUMENTS

| | | | |
|---|---|---|---|
| 1,074,948 | A | 10/1913 | Hiscock |
| 1,323,063 | A | 11/1919 | Johnson |
| 1,563,675 | A | 12/1925 | Tansley |
| 2,341,869 | A | 2/1944 | Johnson, Jr. |
| 3,098,311 | A | 7/1963 | Savioli |
| 3,171,225 | A | 3/1965 | Green |
| 3,177,601 | A | 4/1965 | Meunier |
| 3,319,523 | A | 5/1967 | Casull |
| 3,570,366 | A | 3/1971 | Nickel |
| 3,688,640 | A | 9/1972 | Seecamp |

(Continued)

FOREIGN PATENT DOCUMENTS

| | | |
|---|---|---|
| JP | 2009109171 | 5/2009 |
| WO | 2011056236 | 5/2011 |
| WO | 2011155971 | 12/2011 |

*Primary Examiner* — Jonathan C Weber

(74) *Attorney, Agent, or Firm* — John A. Chionchio, Esq.; Ballard Spahr LLP

(57) ABSTRACT

A rotary ammunition magazine cooperates with a bolt catch to hold the bolt of a firearm out of battery in an open position after the last round has been fired. A cam mounted on the rotor of the magazine actuates a movable body on the magazine housing as the cam rotates to feed ammunition to the action. The body moves to an extended position and engages a bolt catch pivotably mounted in the firearm receiver. The bolt catch is pivoted by the body into a position where it will engage the bolt and prevent it from returning to battery after the last round has been fired.

10 Claims, 4 Drawing Sheets

(56) References Cited

U.S. PATENT DOCUMENTS

| | | | |
|---|---|---|---|
| 3,846,928 | A | 11/1974 | Ruger |
| 4,056,038 | A | 11/1977 | Rath |
| 4,058,922 | A | 11/1977 | Elbe |
| 4,069,607 | A | 1/1978 | Jurek |
| 4,069,608 | A | 1/1978 | Jurek |
| 4,079,535 | A | 3/1978 | Elbe |
| 4,176,584 | A | 12/1979 | Thomas, Jr. |
| 4,455,919 | A | 6/1984 | Osborne |
| 4,617,749 | A | 10/1986 | Jurek |
| 4,672,760 | A | 6/1987 | Chesnut |
| 4,790,094 | A | 12/1988 | Chesnut |
| 4,862,620 | A | 9/1989 | Chesnut |
| 4,901,463 | A | 2/1990 | Chesnut |
| 4,974,356 | A | 12/1990 | Kelsey, Jr. |
| 5,375,359 | A | 12/1994 | Chesnut |
| 5,588,241 | A | 12/1996 | Hurley |
| 6,502,495 | B1 | 1/2003 | Beary |
| 6,510,778 | B1 | 1/2003 | Irwin |
| 6,606,811 | B1 | 8/2003 | Olson |
| 7,261,029 | B1 | 8/2007 | Davis |
| 7,661,219 | B1 | 2/2010 | Knight, Jr. |
| 7,941,955 | B2 | 5/2011 | Stone |
| 8,261,652 | B2 | 9/2012 | Findlay |
| 8,302,340 | B1 | 11/2012 | Irwin |
| 8,359,966 | B1 | 1/2013 | Brotherton |
| 8,387,296 | B2 | 3/2013 | Overstreet |
| 8,479,635 | B2 | 7/2013 | Overstreet |
| 8,572,875 | B2 | 11/2013 | Sisgold |
| 8,677,880 | B2 | 3/2014 | Bowles |
| 8,733,009 | B2 | 5/2014 | Ricks |
| 9,091,499 | B2 | 7/2015 | Overstreet |
| 9,291,412 | B1 | 3/2016 | Montes |
| D760,862 | S * | 7/2016 | Wang ..... D22/108 |
| 9,494,378 | B2 | 11/2016 | Gomez |
| 9,528,784 | B2 | 12/2016 | Roberts |
| 9,605,918 | B1 | 3/2017 | Ballard |
| 10,345,064 | B2 * | 7/2019 | Laney ..... F41A 9/73 |
| 2003/0208940 | A1 | 11/2003 | Johnson |
| 2005/0000138 | A1 | 1/2005 | Kiss |
| 2011/0107901 | A1 | 5/2011 | Lasichak |
| 2011/0107902 | A1 | 5/2011 | Quetschke |
| 2013/0174456 | A1 | 7/2013 | Ricks |
| 2014/0075810 | A1 | 3/2014 | Mikroulis |
| 2014/0076137 | A1 | 3/2014 | Lasichak |
| 2016/0313079 | A1 | 10/2016 | Vickers |
| 2018/0003454 | A1 | 1/2018 | Muska |
| 2018/0080730 | A1 | 3/2018 | Cook et al. |
| 2018/0120043 | A1 | 5/2018 | Duhon |

* cited by examiner

ROTARY MAGAZINE AND BOLT CATCH

CROSS REFERENCE TO RELATED APPLICATIONS

This application is a Divisional of and claims benefit of priority to U.S. patent application Ser. No. 15/787,797, filed Oct. 19, 2017, which application is hereby incorporated by reference herein.

FIELD OF THE INVENTION

This invention relates to rotary ammunition magazines for firearms.

BACKGROUND

It is advantageous that the bolt of a semiautomatic firearm, such as a rifle, be held out of battery in an open position after the last cartridge has been expended. The bolt, held out of battery, immediately alerts the shooter that the magazine is empty and that it is time to reload. However, for some very popular rifles which use a rotary magazine, the bolt is not held open after the last round is fired, but is permitted to run back to battery under the biasing force of its recoil spring. Furthermore, semiautomatic firearm actions cycle so rapidly that it is not usually possible to observe the ammunition status as the rife is being fired. There is clearly an opportunity to improve the operation of such rifles by providing a rotary magazine which works in conjunction with a bolt catch

SUMMARY

The invention concerns an ammunition magazine for a firearm having a bolt capable of reciprocal motion between an open and a closed position. A finger extends from the bolt. A bolt catch is movably mounted on the firearm. The bolt catch has a first surface and a second surface. The second surface is engageable with the bolt and comprises a hook. In one example embodiment the magazine comprises a housing for receiving the ammunition. A cartridge rotor is mounted within the housing. The cartridge rotor is rotatable relatively to the housing about an axis for advancing the ammunition through the housing. A spring is positioned within the housing for rotating the cartridge rotor about the axis. A cam attached to the cartridge rotor and rotating therewith about the axis. A body is mounted on the housing proximate to the cam. The body is slidably movable into an extended position wherein a portion of the body projects from the housing. The portion of the body is adapted to engage the first surface of the bolt catch. A cam follower is mounted on the body. The cam follower is engageable with the cam. Rotation of the cam slides the body into the extended position upon engagement of the cam and the cam follower. When the body moves into the extended position the bolt catch is moved into a position wherein the second surface engages the bolt such that the hook captures the finger. The hook and the finger have non-parallel engagement surfaces that prevent movement of the bolt catch away from the bolt to allow release of the bolt into the closed positioned until the bolt is moved further into the open position away from the hook.

In a specific example the cam comprises a disk attached to the cartridge rotor. A projection extends from the disk. The projection is engageable with the cam follower. By way of example, the projection may extend in a direction parallel to the axis. Further by way of example, the axis passes through a center of the disk. In an example embodiment, the projection is positioned proximate to an edge of the disk.

In a particular example, the body comprises an elongated stem. By way of example, the portion of the body is positioned at an end of the stem. In an example embodiment, the portion of the body further comprises a tab positioned on the end of the stem. The tab is oriented transversely to the stem in an example embodiment. By way of example, the stem is slidable lengthwise into the extended position in a direction transverse to the axis.

In an example embodiment, the cam follower comprises a surface projecting from the stem. The cam engages the surface for moving the stem into the extended position in this example embodiment.

The invention further encompasses a firearm. In an example embodiment the firearm comprises a receiver. A bolt is mounted within the receiver for reciprocal motion relatively thereto between and open and a closed position. A magazine well is positioned within the receiver. An ammunition magazine is positioned within the well. In an example embodiment the magazine comprises a housing for receiving the ammunition. A cartridge rotor is mounted within the housing. The cartridge rotor is rotatable relatively to the housing about an axis for advancing the ammunition through the housing. A spring is positioned within the housing for rotating the cartridge rotor about the axis. A cam is attached to the cartridge rotor and rotates with it about the axis. A body is mounted on the housing proximate to the cam. The body is slidably movable into an extended position wherein a portion of the body projects from the housing. A cam follower is mounted on the body. The cam follower is engageable with the cam. Rotation of the cam slides the body into the extended position upon engagement of the cam and the cam follower. In this example the firearm further comprises a bolt catch movably mounted within the receiver. By way of example the bolt catch comprises a first surface engageable with the portion of the body and a second surface engageable with the bolt. When the body moves into the extended position, the bolt catch is moved into a position wherein the second surface engages the bolt.

In an example embodiment the bolt catch is pivotably mounted within the receiver. By way of example, a spring acts between the receiver and the bolt catch. The spring biases the bolt catch into a position wherein the second surface is not engageable with the bolt.

In an example embodiment the cam comprises a disk attached to the cartridge rotor. A projection extends from the disk. The projection is engageable with the cam follower. In an example embodiment the projection extends in a direction parallel to the axis. Further by way of example, the axis passes through a center of the disk. In another example embodiment, the projection is positioned proximate to an edge of the disk. By way of example, the body comprises an elongated stem. Further by way of example, the portion of the body is positioned at an end of the stem. In another example embodiment, the portion of the body further comprises a tab positioned on the end of the stem. The tab is oriented transversely to the stem in this example. By way of example, the stem is slidable lengthwise into the extended position in a direction transverse to the axis. In an example embodiment, the cam follower comprises a surface projecting from the stem. The cam engages the surface for moving the stem into the extended position.

DETAILED DESCRIPTION

Figure 1:
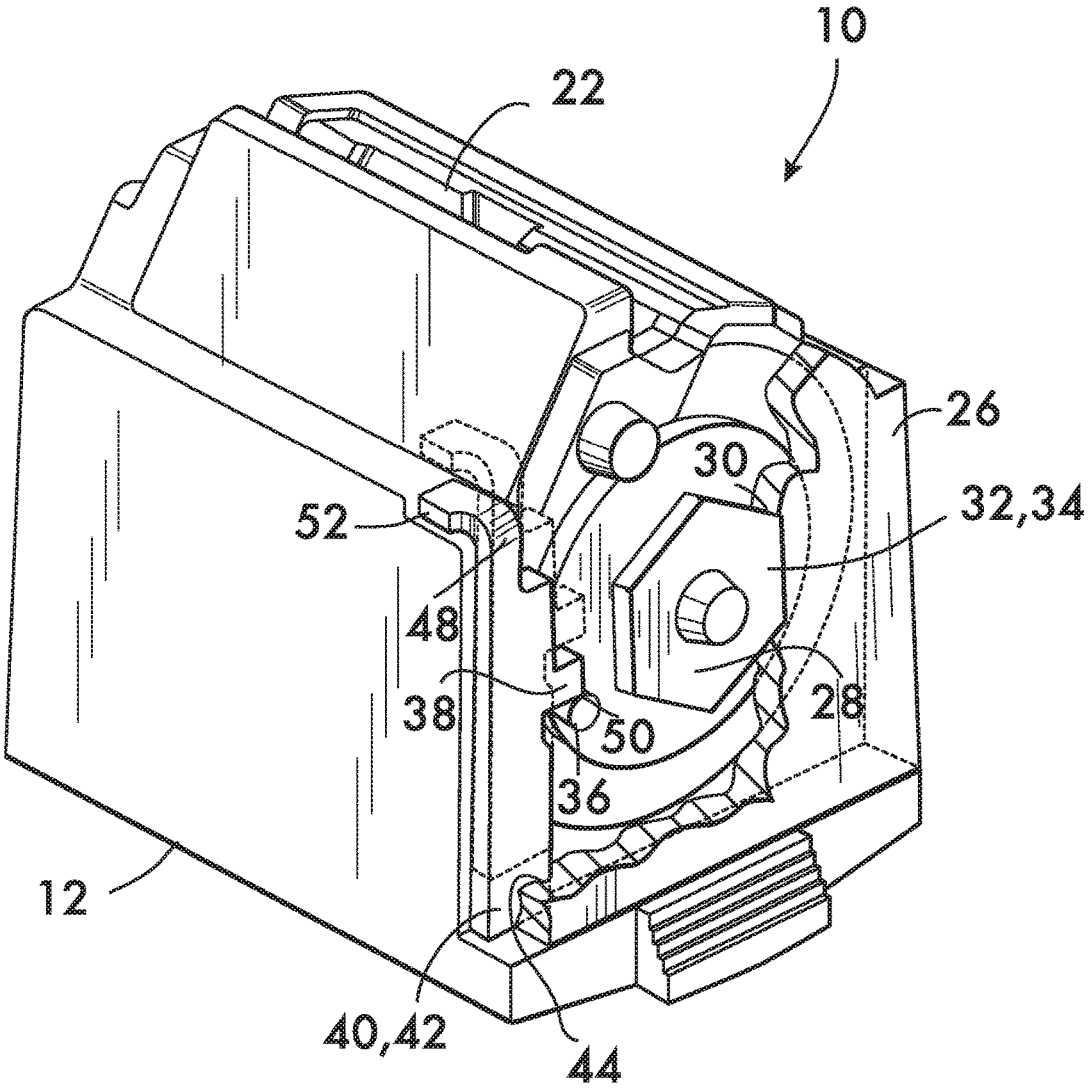
FIG. 1 is a partially cut-away isometric view of an example embodiment of an ammunition magazine for a firearm according to the invention.
Figure 2:
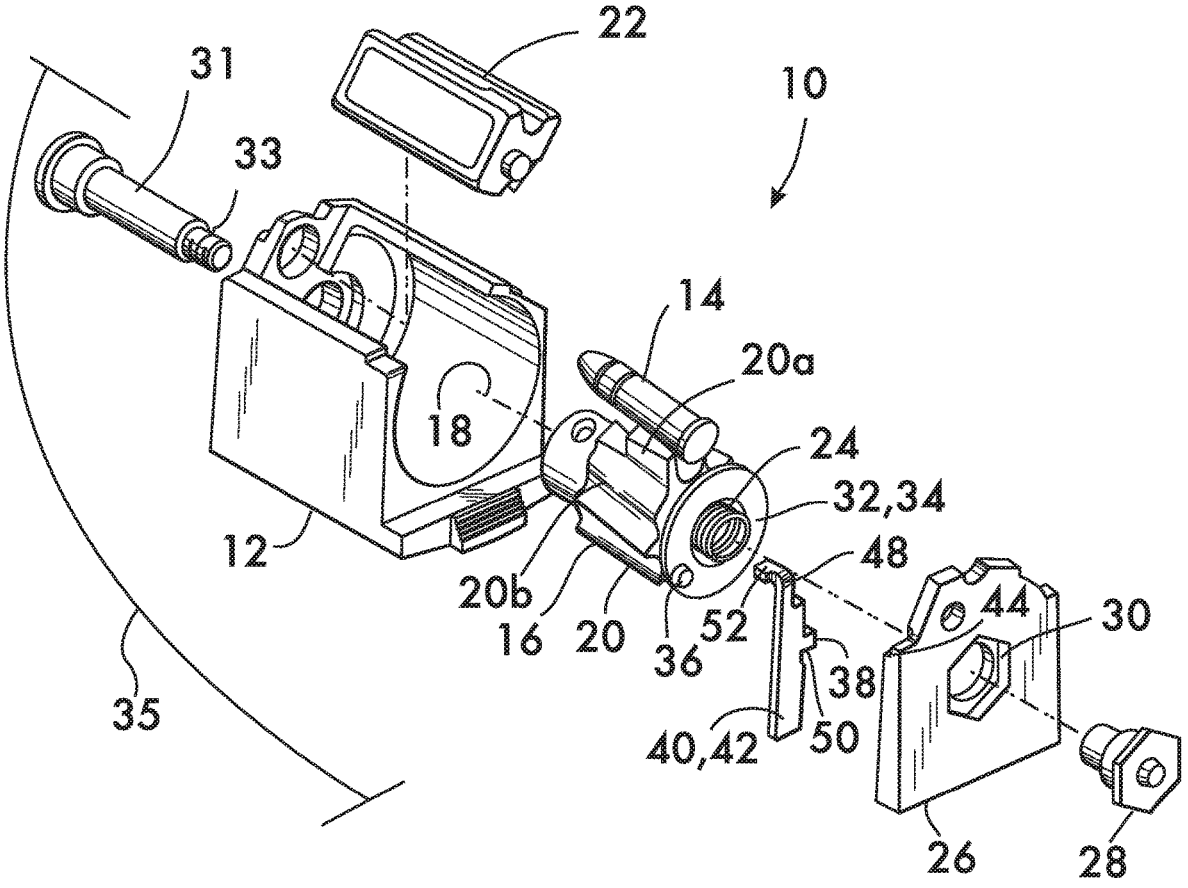
FIG. 2 is an isometric exploded view of the magazine shown in FIG. 1.

FIG. 1 is an isometric view of an example ammunition magazine 10 according to the invention. FIG. 2 shows an isometric exploded view of the magazine 10. As shown in FIG. 2, magazine 10 comprises a housing 12 for receiving ammunition, for example, cartridges 14. The cartridges are advanced through the housing 12 by a cartridge rotor 16. Rotor 16 is rotatable relatively to housing 12 about an axis 18 and has a plurality of radially projecting vanes 20. The cartridges 14 are received on the rotor 16 between the vanes 20 and advanced by contact with the vanes to a pair of feed lips 22 as the rotor 16 rotates. Feed lips 22 are positioned atop the housing 10 and hold each cartridge 14 in turn in a position where the cartridge can be stripped from the magazine 10 by a bolt and subsequently chambered (see FIGS. 3 and 4). One vane, 20*a*, is larger than the other vanes 20*b*, and is the vane which engages the last cartridge 14 held in the magazine 10. Vane 20*a* engages one of the feed lips 22 after the last cartridge 14 has been stripped from the magazine 10 and thus limits the rotation of the rotor 16 within the housing 12.

Rotor 16 is spring biased for rotation about axis 18 by a spring 24 positioned within the housing 12. In this example embodiment, spring 24 is a coil spring having one end attached to rotor 16 and the opposite end fixed to back wall 26 of the housing 12 via a hex-shaped cap nut 28 which fits within a hex-shaped recess 30 in the back wall 26. The hex-shaped cap nut 28 interfitting within recess 30 prevents the cap nut from turning and provides a fixed point to permit the torque of the spring to be applied to and thereby rotate the rotor 16 when the spring 24 is wound by cartridges loaded into the magazine 10. A shaft 31, coaxially aligned with axis 18, passes through the rotor 16 and has a threaded end 33 which engages the cap nut 28 to retain the back wall 26 to the housing 12 and provide a shaft which rotatably supports the rotor 16 within the housing 12.

As shown in FIGS. 1 and 2, a cam 32 is attached to the rotor 16. Cam 32 rotates about axis 18 with the rotor 16 and in this example comprises a disk 34, the axis 18 passing through the center of the disk. A projection 36 extends from the disk 34. In this example the projection 36 extends parallel to the axis 18 and is eccentric to the axis 18, proximate to the edge of the disk 34. Projection 36 is engageable with a cam follower 38. Cam follower 38 is mounted on a body 40 which is slidably mounted on the housing 12. In this example embodiment, body 40 comprises an elongate stem 42 which slides within a groove 44 in the back wall 26. Groove 44 is oriented transversely to axis 18 and stem 42 is thus slidable lengthwise in a direction 46 along groove 44 transversely to the axis 18. Stem 42 is slidably movable into an extended position wherein a portion 48 of the stem 42 (shown in broken line in FIG. 1) projects from housing 12. Movement of the stem 42 into the extended position is effected upon rotation of cam 32 and engagement of the cam and the cam follower 38. In this example the cam follower 38 comprises a surface 50 projecting from the stem 42 which is engaged by the projection 36 extending from disk 34. It is advantageous to position a tab 52 at the end of stem 42, the tab 52 being oriented transversely to the stem.

FIG. 2 shows the angular separation 35 between the projection 36 and the large vane 20*a*, which is set such that after the last of cartridges 14 is stripped from the magazine 10 and the rotor 16 rotates to its limit (as determined by engagement between the large vane 20*a* and one of the feed lips 22) the projection 36 engages the cam follower (surface 50) and slides stem 42 into the extended position shown in broken line in FIG. 1. This permits the stem 42 to actuate a bolt catch as described below.

Figure 3:
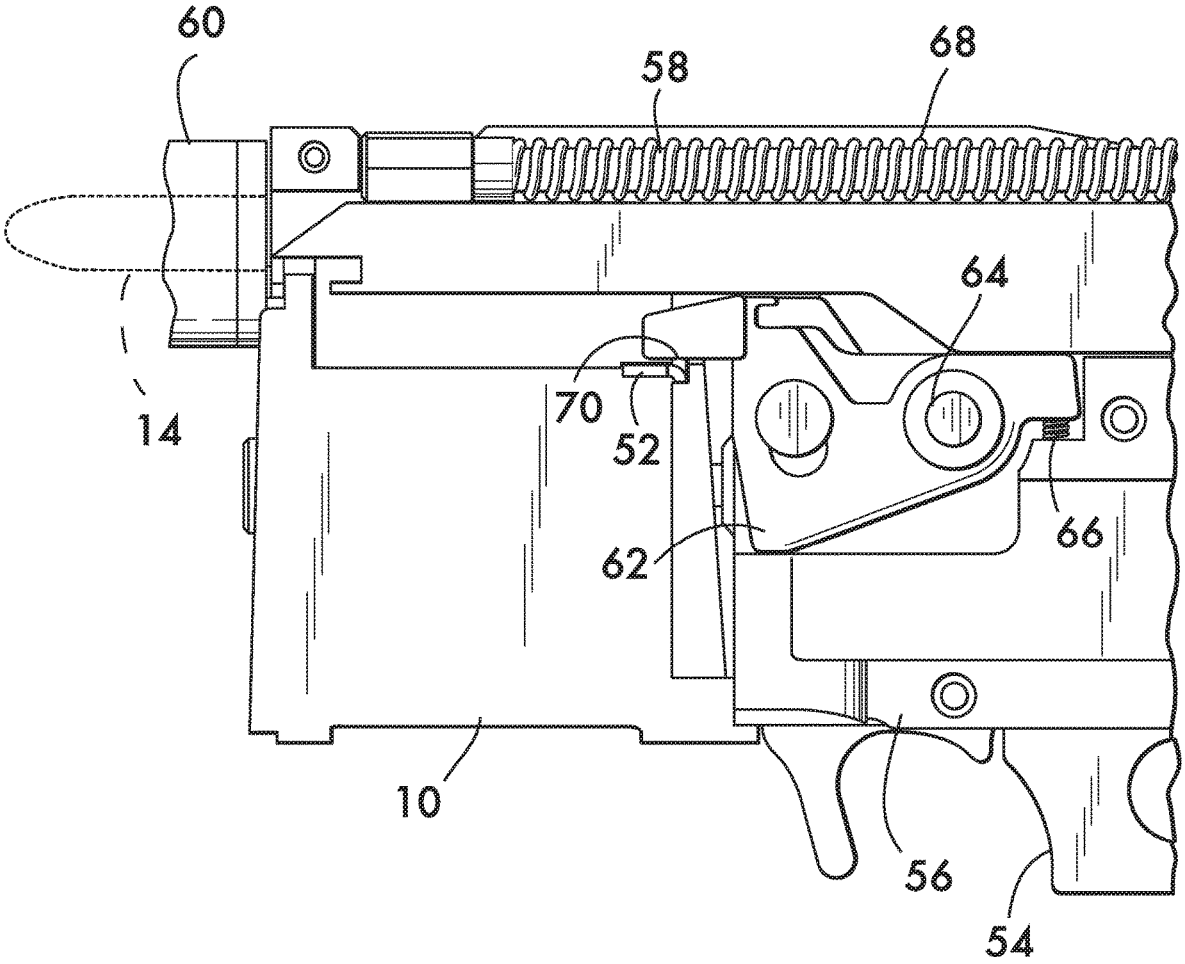
FIGS. 3 and 4 are partial sectional views of a receiver of a firearm showing the operation of the magazine according to the invention.
Figure 4:
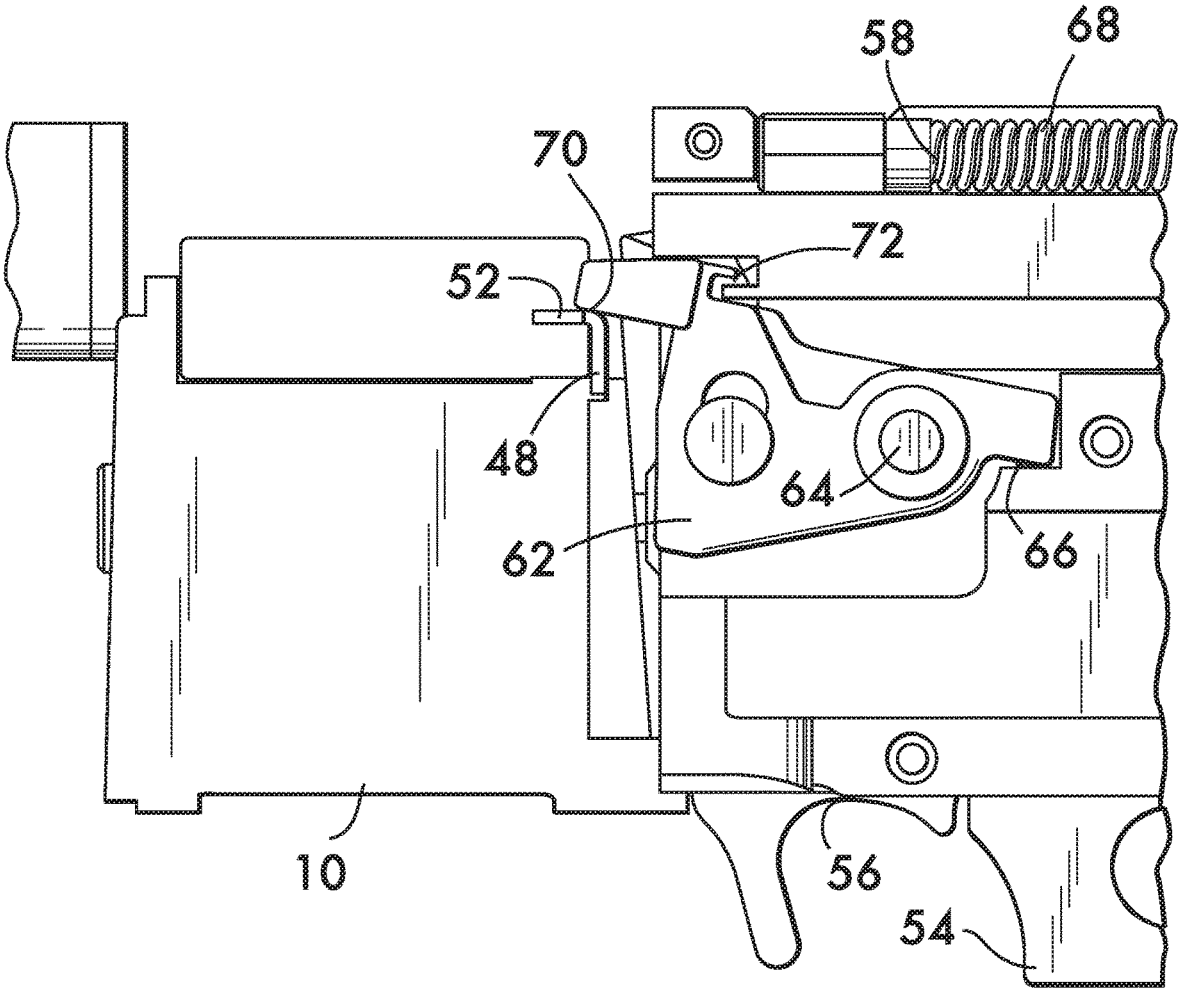

Operation of the magazine 10 is described with reference to FIGS. 1-4. FIG. 3 shows a receiver 54 of a firearm 56 wherein a bolt 58 has stripped the last cartridge 14 from the magazine 10 and chambered the cartridge in the barrel chamber 60, the bolt 58 shown in the closed position. A bolt catch 62 is movably mounted within the receiver 54. In this example the bolt catch 62 is pivotably mounted for pivoting motion about an axis 64. A spring 66 acts between the receiver 54 and the bolt catch 62 to bias the bolt catch into a position where the bolt catch is not engageable with the bolt 58. FIG. 4 shows the receiver 54 after the last cartridge 14 has been fired. The bolt 58, operating on the "blow back" principle in this example, recoils out of battery in response to the change in momentum caused when the projectile of the cartridge 14 is propelled down the barrel upon discharge. As it moves into the open position, the bolt 58 withdraws the spent casing from chamber 60 and the casing is ejected from the receiver 54 (not shown). Motion of the bolt 58 out of battery compresses the recoil spring 68 as it moves into the open position. If there were another cartridge in the magazine 10 the recoil spring would drive the bolt back into the closed position, stripping and chambering a cartridge from the magazine as it went. However, because the last cartridge has been fired, the cam 32 is permitted to rotate under the torque applied by spring 24 (see FIG. 2) so that projection 36 engages the cam follower surface 50 (see FIG. 1) and moves the stem 42 lengthwise within the groove 44 into the extended position as shown in FIG. 4 where the portion 48 of the stem 42 projects from the housing 12. Motion of the stem 42 causes tab 52 at the end of stem 42 to engage a first surface 70 on the bolt catch 62, pivoting the bolt catch against its biasing spring 66 and into the path of the returning bolt 58 wherein a second surface 72 on the bolt catch engages and holds the bolt 58 in the open position shown. With the bolt 58 in the open position the shooter may remove the empty magazine from the magazine well and insert a full magazine. Bolt 58 is held in the open position until it is released by pulling the operating lever (not shown) rearward and releasing the lever.

Magazines according to the invention, when used with bolt catches, are expected to improve the operation semi-automatic rifles without such features by alerting the shooter when the last cartridge has been fired by holding the bolt in the open position.

What is claimed is:

1. An ammunition magazine for a firearm having a bolt capable of reciprocal motion between an open and a closed position, a finger extending from said bolt, a bolt catch movably mounted on said firearm, said bolt catch having a first surface and a second surface, said second surface being engageable with said bolt and comprising a hook, said magazine comprising:

a housing for receiving said ammunition;

a cartridge rotor mounted within said housing, said cartridge rotor being rotatable relatively to said housing about an axis for advancing said ammunition through said housing;

a spring positioned within said housing for rotating said cartridge rotor about said axis;

a cam attached to said cartridge rotor and rotating therewith about said axis;

a body mounted on said housing proximate to said cam, said body being slidably movable into an extended position wherein a portion of said body projects from said housing, said portion of said body being adapted to engage said first surface of said bolt catch;

a cam follower mounted on said body, said cam follower being engageable with said cam, rotation of said cam sliding said body into said extended position upon engagement of said cam and said cam follower; wherein when said body moves into said extended position, said bolt catch is moved into a position wherein said second surface engages said bolt such that said hook captures said finger, said hook and said finger having non-parallel engagement surfaces that prevent movement of said bolt catch away from said bolt to allow release of said bolt into said closed positioned until said bolt is moved further into said open position away from said hook.

2. The magazine according to claim 1, wherein said cam comprises:

a disk attached to said cartridge rotor;

a projection extending from said disk, said projection being engageable with said cam follower.

3. The magazine according to claim 2, wherein said projection extends in a direction parallel to said axis.

4. The magazine according to claim 2, wherein said axis passes through a center of said disk.

5. The magazine according to claim 2, wherein said projection is positioned proximate to an edge of said disk.

6. The magazine according to claim 1, wherein said body comprises an elongated stem.

7. The magazine according to claim 6, wherein said portion of said body is positioned at an end of said stem.

8. The magazine according to claim 7, wherein said portion of said body further comprises a tab positioned on said end of said stem, said tab being oriented transversely to said stem.

9. The magazine according to claim 6, wherein said stem is slidable lengthwise into said extended position in a direction transverse to said axis.

10. The magazine according to claim 6, wherein said cam follower comprises a surface projecting from said stem, said cam engaging said surface for moving said stem into said extended position.

* * * * *